United States Patent [19]

Tada et al.

[11] 4,233,397

[45] Nov. 11, 1980

[54] PROCESS FOR THE PREPARATION OF COUPLER DISPERSIONS

[75] Inventors: Sugihiko Tada; Yuzo Inukai, both of Minami-ashigara, Japan

[73] Assignee: Fuji Photo Film Co., Ltd., Minami-ashigara, Japan

[21] Appl. No.: 43,584

[22] Filed: May 29, 1979

Related U.S. Application Data

[63] Continuation-in-part of Ser. No. 858,868, Dec. 8, 1977, abandoned.

[30] Foreign Application Priority Data

Dec. 8, 1976 [JP] Japan ..... 51-147506
Aug. 30, 1977 [JP] Japan ..... 52-104010

[51] Int. Cl.[2] ..... G03C 1/40

[52] U.S. Cl. ..... 430/449; 430/546; 210/644

[58] Field of Search ..... 430/449, 546; 210/22 R, 210/23 F

[56] References Cited

U.S. PATENT DOCUMENTS

| | | | |
|---|---|---|---|
| 2,949,360 | 8/1960 | Julian . | |
| 3,193,582 | 7/1965 | Adams et al. | 210/23 F |
| 3,769,206 | 10/1973 | Brown et al. | 210/22 |
| 4,035,291 | 7/1977 | Chiang et al. | 210/23 F |

OTHER PUBLICATIONS

Mears, Membrane Separation Processes, pp. 2–5, Elsevier Scientific Publishing Co. (1976).

*Primary Examiner*—J. Travis Brown
*Attorney, Agent, or Firm*—Sughrue, Rothwell, Mion, Zinn and Macpeak

[57] ABSTRACT

A process for preparing a coupler dispersion comprising contacting a coupler dispersion containing an auxiliary solvent with an auxiliary solvent carrying fluid medium through a hydrophobic macroporous film made of polytetrafluroethylene or polypropylene.

22 Claims, 9 Drawing Figures

PROCESS FOR THE PREPARATION OF COUPLER DISPERSIONS

RELATED APPLICATIONS

This application is a continuation-in-part of U.S. application Ser. No. 858,868 filed Dec. 8, 1977 in the names of Tada et al and entitled PROCESS FOR THE PREPARATION OF COUPLER DISPERSIONS, now abandoned.

BACKGROUND OF THE INVENTION

1. Field of the Invention

The present invention relates to a process for the preparation of photographic coupler dispersions. More particularly, it relates to a process for removing a partially water-soluble auxiliary solvent contained in a photographic coupler dispersion in producing the photographic coupler dispersion.

2. Description of the Prior Art

A photographic coupler dispersion has hitherto been produced by dissolving a coupler in an appropriate high-boiling point solvent and homogenizing the resulting solution in an aqueous hydrophilic colloid, e.g., gelatin solution. To accomplish this procedure, however, an excess amount of the high-boiling solvent in comparision with the amount of the coupler must be used. Such an excess amount of the high-boiling solvent does not contribute at all to the photographic properties, and it decreases the physical hardness of the coating film. Therefore, a procedure has generally been employed which comprises adding a water-insoluble or water-soluble auxiliary solvent having a lower boiling point to the solution prepared by dissolving the coupler in the high-boiling solvent, and then dispersing the resulting solution in an aqueous hydrophilic colloid, e.g., gelatin solution (for example, as disclosed in U.S. Pat. Nos. 2,801,170, 2,801,171, etc.).

Since such an auxiliary solvent-containing coupler dispersion has poor stability with the lapse of time, removal of such an auxiliary solvent is desirable.

Known procedures for removing such an auxiliary solvent include a method in which a coupler dispersion is gelled by cooling, the gel is cut into small pieces or extruded in a noodle form, and the gel thus obtained is washed with cold water, a method in which a coupler dispersion is extruded from a heat-insulating extrusion head into cold water to form a noodle of the dispersion instantaneously, and the product so obtained is washed with cold water (e.g., as disclosed in U.S. Pat. No. 3,396,027), a method in which a noodle of a coupler dispersion is dried with air, a method in which a coupler dispersion is coated on a drum in the form of a thin film and dried, etc., are known.

The procedure in which the dispersion is gelled, cut into small pieces or extruded in a noodle form, and washed with water, however, has the disadvantages that the gel absorbs water during the processing, swells and disintegrates, that the gel dissolves in the washing water, and that the water content of the coupler dispersion after the processing is increased more than necessary.

In the procedure in which the auxiliary solvent is removed by evaporation in the air or in vacuo, vaporization of the water together with the auxiliary solvent and increase of the water content of the coupler dispersion more than necessary are problems.

Such a change in the water content is a quite serious problem from the standpoint of process control, and it is also an important problem from the standpoint of storage stability of the dispersion.

SUMMARY OF THE INVENTION

A principal object of the present invention is to provide a process for producing a coupler dispersion which removes the above described prior art defects, and which enables an auxiliary solvent to be removed without deteriorating the characteristics of the coupler dispersion and with a quite small change in the water content occurring.

The object of this invention is attained by contacting the coupler dispersion containing the auxiliary solvent through a hydrophobic macroporous film made of polytetrafluroethylene or polypropylene with an auxiliary solvent-carrying fluid medium. That is, the coupler dispersion containing the auxiliary solvent is contacted through the hydrophobic macroporous film made of polytetrafluroethylene or polypropylene with the auxiliary solvent-carrying fluid medium to thereby selectively cause the auxiliary solvent present in the coupler dispersion to diffuse through the hydrophobic macroporous film made of polytetrafluroethylene or polypropylene whereby the auxiliary solvent passes into the auxiliary solvent-carrying fluid medium.

DETAILED DESCRIPTION OF THE INVENTION

In the following, the term "hydrophobic macroporous film" refers to such a film made of polytetrafluroethylene or polypropylene.

Figure 1:
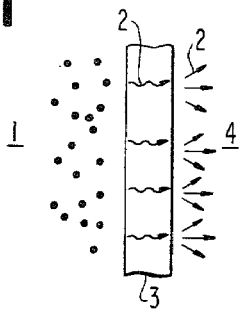
FIG. 1 is a schematic view showing the principle of the present invention.

Turning now to the figures, FIG. 1 schematically illustrates the phenomenon where an auxiliary solvent present in a coupler dispersion diffuses through a hydrophobic macroporous film and passes into a fluid medium capable of carrying or transporting the auxiliary solvent, herein designated "an auxiliary solvent-carrying fluid medium" such as water, air or the like. Auxiliary solvent 2 present in the coupler dispersion diffuses through the hydrophobic macroporous film made of polytetrafluroethylene or polypropylene and passes therethrough. Then the auxiliary solvent passes into the hydrophobic macroporous film and is removed from the surface of the hydrophobic macroporous film by water or air 4. However, since it is not possible for the water present in coupler dispersion 1 to pass through hydrophobic macroporous film 3, the difference in the water content of coupler dispersion 1 before and after the removal of the auxiliary solvent is extremely small.

Figure 2:
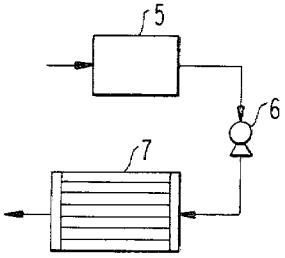
FIGS. 2 and 6 are flow diagrams of the equipment for producing a coupler dispersion according to the present invention.
Figure 3:
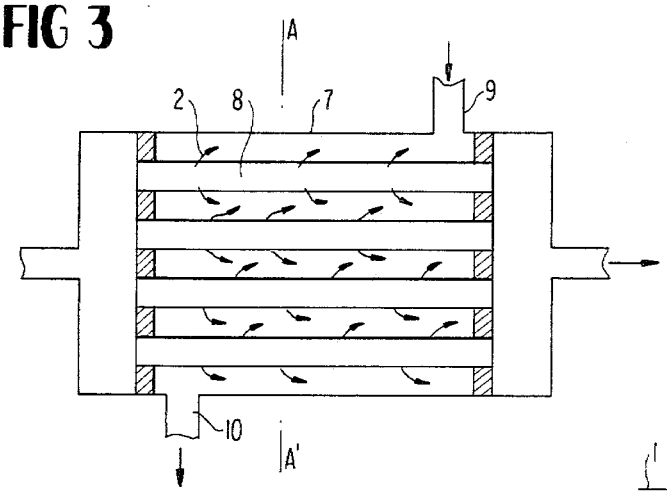
FIGS. 3, 5 and 7 are schematic sectional views of the equipment for removing an auxiliary solvent according to the present invention.
Figure 4:
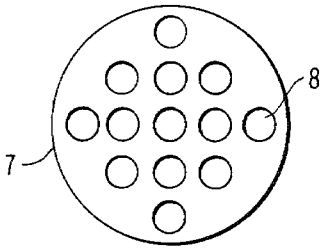
FIGS. 4 and 8 are, respectively, a cross sectional view of FIG. 3 and a cross sectional view taken along the plane A-A' of FIG. 7.

FIG. 2 is a flow diagram of an apparatus for producing a coupler dispersion according to one embodiment of the present invention. FIG. 3 is a schematic sectional view of one embodiment of an apparatus for removing the auxiliary solvent. FIG. 4 is a cross sectional view taken along the plane A-A' of FIG. 3.

Referring to FIGS. 2, 3 and 4, coupler dispersion 1 containing auxiliary solvent 2, which is prepared in homogenizing unit 5, is transferred by pump 6 to auxiliary solvent removing unit 7 wherein auxiliary solvent 2 is removed. Auxiliary solvent removing unit 7 is provided with a plurality of circular pipes 8 whose walls are composed of a hydrophobic macroporous film as shown in FIG. 4. An auxiliary solvent carrying fluid medium such as water is countercurrently fed around pipes 8 from inlet opening 9 and is withdrawn from outlet opening 10. Coupler dispersion 1 fed into auxiliary solvent-removing unit 7 flows in circular pipe 8. The auxiliary solvent 2 present in coupler dispersion 1 diffuses through the hydrophobic macroporous film and passes, e.g., is extracted, into the auxiliary solvent-carrying fluid medium, such as water, flowing outside the wall. Since it is not possible for the other components present in coupler dispersion 1 to pass through the hydrophobic macroporous film, the auxiliary solvent 2 alone is selectively removed.

Figure 5:
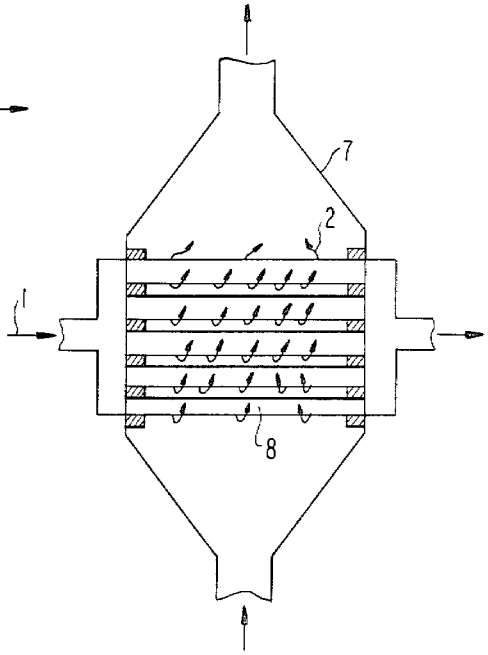

FIG. 5 is a schematic cross sectional view of another embodiment of an apparatus for removing the auxiliary solvent. In FIG. 5, air saturated with water is used in place of water as an auxiliary solvent-carrying fluid medium, and the air is introduced around circular pipe 8 in such a manner that it flows across a plurality of pipes 8. Thus, auxiliary solvent 2 present in coupler dispersion 1 flowing in circular pipe 8 diffuses through the hydrophobic macroporous film and passes, e.g., vaporizes, into the air and is removed from the coupler dispersion 1.

In the above embodiment shown in FIG. 5, the coupler dispersion is subjected to the auxiliary solvent-removing processing with the dispersion being in the sol state. In this case, the temperature at which the auxiliary solvent is removed needs to be above the temperature at which it is possible to maintain the coupler dispersion in the sol state, and below the temperature at which adverse influences on photographic characteristics take place. Thus the temperature is ordinarily about 40° to about 60° C., preferably 45° to 50° C.

Figure 6:
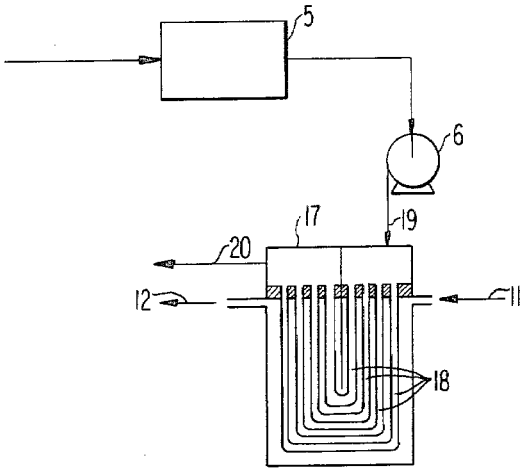
Figure 7:
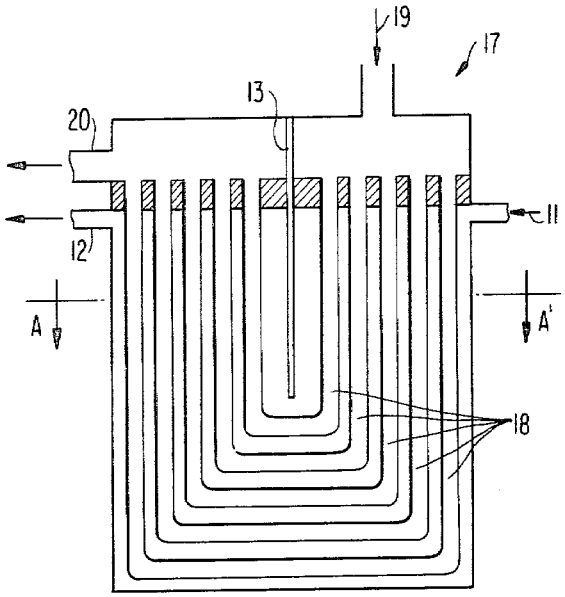
Figure 8:
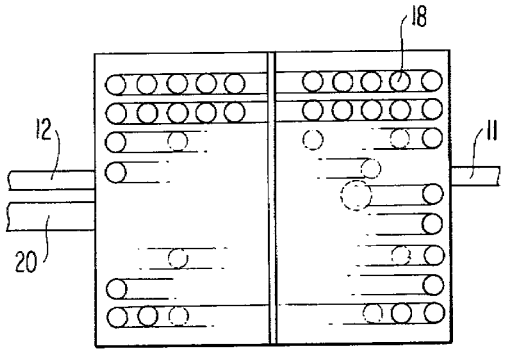

FIG. 6 is a flow diagram of another embodiment of a process for producing a coupler dispersion of the present invention. FIG. 7 is a schematic cross sectional view of one embodiment of an apparatus for removing the auxiliary solvent from the coupler dispersion. FIG. 8 is a cross sectional view taken along the plane A-A' of FIG. 7.

Referring now to FIGS. 6, 7 and 8, coupler dispersion 1 containing auxiliary solvent 2, which is prepared in homogenizing unit 5, is transferred with pump 6 to auxiliary solvent removing unit 17 wherein coupler dispersion 1 fills a space 18 divided with hydrophobic macroporous films. The coupler dispersion 1 is then gelled by a cooling fluid flowing outside of the hydrophobic macroporous films. This cooling fluid may be either the same as the auxiliary solvent-carrying fluid medium or different therefrom. Thereafter, the auxiliary solvent-carrying fluid medium is sufficiently cooled to extract and remove the auxiliary solvent and is fed from the hydrophobic macroporous film from inlet opening 11. Thus auxiliary solvent 2 is removed.

A plurality of circular pipes 8 whose walls are composed of a hydrophobic macroporous film in a hairpin form are placed in auxiliary solvent removing unit 17 as shown in FIG. 4. The coupler dispersing in the sol state enters unit 17 from inlet opening 19 and fills space 18 formed by circular pipes 8 in a hairpin form. The coupler dispersion is then gelled by cold water, e.g., at about 5° to about 20° C., acting as either a cooling fluid and an auxiliary solvent-carrying fluid medium which comes from inlet opening 11. The cold water is continuously fed through inlet opening 11. During this processing, the auxiliary solvent present in the coupler dispersion in the gel state diffuses through the gel, reaches the hydrophobic macroporous film, and further diffuses through the hydrophobic fine porous film, and the auxiliary solvent is thus extracted into the cold water. Since it is not possible for other components present in coupler dispersion 1 to pass through the hydrophobic macroporous film, auxiliary solvent 2 alone is selectively removed.

To reduce the material transfer resistance of the hydrophobic macroporous film, the hydrophobic macroporous film can be impregnated with an oil and the like which have a great partition coefficient to the auxiliary solvent and are insoluble in water.

Baffle 13 as shown in FIG. 7 separates auxiliary solvent removing unit 17 into a coupler dispersion inlet side and a coupler dispersion outlet side, and at the same time, the baffle prevents the cooling fluid coming from inlet opening 11 from directly flowing out outlet opening 12. After the extraction of the auxiliary solvent with the cooling fluid is completed, warm water, e.g., at about 40° to 50° C., is introduced through inlet opening 11 to melt the coupler dispersion, and the warm water is withdrawn from outlet opening 20 by the pressure of the air e.g., at about 40° to 50° C. from inlet opening 19. As a matter of course, the auxiliary solvent removing unit 17 may be slanted so that outlet opening 20 is directed downwardly.

In the above embodiment described in FIG. 7, the processing temperature can be lowered to low temperatures (usually about 0° to about 20° C., preferably 1° to 5° C.) as long as the water present in the coupler dispersion is not frozen, because the coupler dispersion is initially gelled and it is then subjected to the auxiliary solvent removing operation in the gel state. Therefore, it is possible to increase the solubility of the auxiliary solvent in the auxiliary solvent-carrying fluid medium, which is desirable from the standpoint of efficiency.

In these embodiments, the dimensions of the circular pipe 8 whose wall is composed of a hydrophobic macroporous film and the number of the circular pipes 8 employed are determined depending on the amount of coupler dispersion 1 being processed. The only requirement is for the difference in pressure between the outside and inside of circular pipe 8 to be below the water entry pressure of the hydrophobic macroporous film.

The present invention is not to be construed as being limited to the above described embodiments alone and various alternative embodiments can be used. For example, if the coupler dispersion needs to be maintained at a constant temperature from the homogenizing step, pipes may be provided with a jacket and the like. In addition, the pipes whose walls are made of the hydrophobic macroporous film do not always need to be circular, and the arrangement of the pipes is not limited to the one described above. To increase the efficiency of removing the auxiliary solvent, it is desirable for the pipes to be arranged so that they contact the auxiliary solvent-carrying fluid medium uniformly and sufficiently.

Although it is preferred for the auxiliary solvent-carrying fluid medium to be fed countercurrently to or in a crosswise relationship relative to the flow of the coupler dispersion, the auxiliary solvent-carrying fluid medium may be fed in the same direction as the coupler dispersion flow. It is also possible for the auxiliary solvent-carrying fluid medium to be introduced into the pipe made of the hydrophobic macroporous film and for the coupler dispersion to be passed around the pipe. Wire made of a metal such as stainless steel or the like in the form of a coil may be inserted in the pipe to prevent deformation of the pipe. It is also possible for the coupler dispersion and the auxiliary solvent-carrying fluid medium to be separated from each other by a sheet made of a hydrophobic macroporous film, and the auxiliary solvent is extracted into the auxiliary solvent-carrying fluid medium and removed, and no pipe is used. This procedure, however, has poorer efficiency in comparison with the above described embodiments.

The term "coupler" as used in the present invention designates those compounds capable of forming dyes on reaction with the oxidation products of color developing agents, i.e., aromatic amine (usually primary aromatic amine) developing agents. The invention is particularly effective for non-diffusable couplers containing a hydrophobic group, called a ballast group, in the molecule. The invention is applicable to coupler dispersions containing couplers which are either four equivalent or two equivalent couplers. Furthermore, the invention can be suitably used with coupler dispersions containing colored couplers having the effect of color correction, or couplers liberating a developing inhibitor on development, i.e., the so-called DIR couplers. Coupler dispersions containing couplers forming colorless products on coupling may be subjected to the process of this invention.

Yellow couplers which can be present in the coupler dispersion subjected to the process of the present invention include known open chain ketomethylene based couplers. Among these couplers, benzoylacetoanilide based and pivaloyl acetoanilide based compounds can be advantageously employed. Representative examples of these yellow couplers are described in U.S. Pat. Nos. 2,875,057, 3,265,506, 3,408,194, 3,551,155, 3,582,322, 3,725,072, 3,891,445, West German Pat. No. 1,547,868, West German patent application (OLS) Nos. 2,213,461, 2,219,917, 2,261,361, 2,263,875, 2,414,006, etc.

Magenta couplers which can be present in the coupler dispersion subjected to the process of the present invention include pyrazolone based compounds, indazolone based compounds, cyanoacetyl compounds and the like. Of these compounds, pyrazolone based compounds can be advantageously used. Representative examples are described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908, 3,891,445, West German Pat. No. 1,810,464, West German patent application (OLS) Nos. 2,408,665, 2,417,945, 2,418,959, 2,424,467, Japanese Patent Publication No. 6031/1965, etc.

Cyan couplers which can be present in the coupler dispersion subjected to the process of the present invention include phenol based compounds, naphthol based compounds and the like and suitable examples are described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411, German patent application (OLS) Nos. 2,414,830, 2,454,329, Japanese patent application (OPI) No. 59838/1973.

Colored couplers such as those described, for example, in U.S. Pat. Nos. 3,476,560, 2,521,908, 3,034,892, Japanese Patent Publication Nos. 2016/1969, 22335/1963, 11304/1967, 32461/1969, Japanese patent application Nos. 98469/1974, 118029/1975, West German patent application (OLS) No. 2,418,959 can be present in the dispersion subjected to the process of this invention.

Examples of DIR couplers, which can be present in the coupler dispersion subjected to the process of this invention, include, for example, those described in U.S. Pat. Nos. 3,227,554, 3,617,291, 3,701,783, 3,790,384, 3,632,345, West German patent application (OLS) Nos. 2,414,006, 2,454,301, 2,454,329, British Pat. No. 953,454, Japanese patent application No. 146,570/1975.

In addition to DIR couplers, those compounds capable of liberating a development inhibitor on development can be present in the coupler dispersion subjected to the process of this invention. For example, those described in U.S. Pat. Nos. 3,297,445, 3,379,529, West German patent application (OLS) No. 2,417,914 can be present.

Auxiliary solvents which can be used in the coupler dispersion and removed using the process of the present invention include those generally employed in coupler dispersions. In general a suitable boiling point range for the auxiliary solvents is from above about 60° C. to around 100° C. or slightly above. Specific examples of auxiliary solvents to which this invention is applicable include nitromethane, nitroethane, methyl acetate, ethyl acetate, propyl acetate, butyl acetate, butyl fromate, 2-(2-butoxyethoxy)ethyl acetate and the like. In general, the amount of the auxiliary solvent present in the coupler dispersion will range from about 6 to about 15% by weight based on the coupler dispersion weight. After subjecting the coupler dispersion to the process of this invention to remove the auxiliary solvent, the proportion of auxiliary solvent remaining in the coupler dispersion is less than about 3% by weight based on the coupler dispersion weight.

The hydrophobic macroporous film used in the process of the present invention can be suitably made of polytetrafluoroethylene or polypropylene, which can be prepared e.g., as described in Japanese patent application (OPI) No. 7284/1971. The hydrophobic macroporous film contains numerous pores with an average pore size of about 0.1 to about 40$\mu$, preferably 0.1 to 5$\mu$, more preferably 0.2 to 2$\mu$, a porosity of about 25 to about 95%, preferably 40 to 70%, and a film thickness of desirably about 20 to about 1,000$\mu$, preferably 20 to 200$\mu$, more preferably 20 to 100$\mu$.

The hydrophobic macroporous film used in the process of the present invention can be distinguished from the membrane of U.S. Pat. No. 3,769,206 Brown et al which is classified as a microporous membrane of micropores with diameter comparable with the thickness of the polymer chains. (Membrane Separation Processes, edited by Patrick Mears, Elsevier Scientific Publishing Co. pp. 2–5, 1976)

Auxiliary solvent-carrying fluid media which can be used in the process of the present invention, in addition to water and air as described in the above embodiments, include, air and non-reactive gases saturated with water vapor, aqueous solutions of those compounds whose vapor pressure at the temperature of operation, e.g., at about 0° C. to about 50° C., is low, e.g., about 0.1 to about 1 mmHg, and which increase the solubility of the auxiliary solvent in water, such as glycerin, ethylene glycol, formamide, dimethylformamide and the like, and dispersions in which activated carbon and the like capable of adsorbing the auxiliary solvent are dispersed can be employed.

In the present invention, the difference in pressure between the outside and inside of the hydrophobic macroporous film must below the water entry pressure, e.g., about 0.5 to about 1.0 kg/cm$^2$.

The following examples and comparative examples are given to explain the present invention in more detail. Unless otherwise indicated herein, all parts, percents, ratios and the like are by weight.

EXAMPLE 1

A coupler dispersion having the composition shown in Table 1 below was prepared.

TABLE 1

| | Amount (wt%) |
|---|---|
| Yellow Coupler | 7 |
| Gelatin | 7 |
| Ethyl Acetate | 8 |
| Di-n-butyl Phthalate | 10.5 |
| Water | 69 |
| Sodium Dodecylbenzene Sulfonate | 0.5 |

100 g of the coupler dispersion so prepared was introduced into a macroporous film tube made of polytetrafluoroethylene at 50° C. This macroporous film tube had an inner diameter of 3.6 mm, an outer diameter of 4.7 mm, a density of 0.8 g/cc, a porosity of 65%, a water entry pressure of 0.9 Kg/cm$^2$ and a total length of 2 m, and the tube was immersed in 500 cc of distilled water at a temperature of 50° C. The speed of feeding the coupler dispersion through the tube was 4 cc/min, and the coupler dispersion was repeatedly circulated.

Fifteen minutes after the beginning of the processing, the processing was interrupted, and analysis was conducted. The concentration of ethyl acetate decreased to 2.2 wt%, but there was materially no change in the water content. No difficulties with the stability of the coupler dispersion after the processing with the lapse of time were observed.

EXAMPLE 2

The procedures of Example 1 were repeated with the exception that the temperature of the coupler dispersion was changed to 45° C. The concentration of ethyl acetate present in the coupler dispersion decreased to 3.1 wt% after 15 minutes after the beginning of the processing, and to 2.3 wt% after 30 minutes. In each case, no difficulty was encountered with the stability with time of the coupler dispersion.

EXAMPLE 3

The same coupler dispersion as described in Example 1 was treated with the same macroporous film tube as described in Example 1 and air saturated with water vapor and at 45° C. was used in place of the distilled water. The air was blown at a right angle to the tube at a flow rate of 9 cm/sec. After a lapse of 30 minutes from the start of the processing, the concentration of the ethyl acetate present in the coupler dispersion decreased to 2.9 wt%. No difficulty with the stability with time of the coupler dispersion after the processing was observed.

Comparative Example 1

100 g of the same coupler dispersion as described in Example 1 in the form of a noodle of a diameter of 2 mm was immersed in 1.5 liters of water at 5° C. After a lapse of 3 hours, the concentration of the ethyl acetate decreased to 2.7 wt%, but the coupler dispersion absorbed water and swelled to about 2 times its original volume.

EXAMPLE 4

A coupler dispersion having the composition shown in Table 2 below was prepared.

TABLE 2

| | Amount (wt %) |
|---|---|
| Yellow Coupler | 7 |
| Gelatin | 7 |
| Ethyl Acetate | 8 |
| n-Butanol | 5 |
| Di-n-butyl Phthalate | 4 |
| Water | 68.5 |
| Sodium Dodecylbenzene Sulfonate | 0.5 |

About 10 cc of the coupler dispersion so prepared was filled in a sol state in a fine porous film tube made of polytetrafluoroethylene, and both ends of the tube were sealed with clips.

The macroporous film tube used in this example had an inner diameter of 3.6 mm, an outer diameter of 4.7 mm, a density of 0.8 g/cc, a porosity of 65%, and a total length of 1 m and the water entry pressure was 0.9 Kg/cm$^2$. The tube charged with the coupler dispersion was immersed in a tank charged with 5 liters of cold water at about 5° C. for three hours, and the tube was then removed therefrom. The coupler dispersion was melted with hot water at about 35° C. and withdrawn from the tube. The concentrations of the ethyl acetate and n-butanol were measured, and the concentration of ethyl acetate was 0.8 wt% and the concentration of n-butanol decreased to 1.53 wt%. Materially no change in the water content was found. No difficulty with the stability with time of the coupler dispersion after the processing was observed.

EXAMPLE 5

A tube of polytetrafluoroethylene as described in Example 4 above which had previously been impregnated with di-n-butylphthalate was charged with about 10 cc of a coupler dispersion having the composition shown in Table 2 above, and both ends of the tube were sealed. This tube was immersed in 5 liters of cold water at about 5° C. for 3 hours in the same manner as described in Example 1 and the tube was then taken out. The concentrations of the ethyl acetate and n-butanol were measured and found to be respectively 0.35 wt% and 0.75 wt%. Materially no change in the water content was found. No problem with the stability with time of the coupler dispersion after the processing occurred.

EXAMPLE 6

A tube charged with the same coupler dispersion as shown in Table 2 was immersed in 5 liters of a 10 wt% aqueous solution of glycerin at about 5° C. for 3 hours, and the tube was then removed. The concentration of the ethyl acetate and n-butanol were measured, and it was found that the concentrations of the ethyl acetate and n-butanol decreased, respectively, to 0.48% and 0.48% by weight. The water content of the coupler dispersion did not materially change, and no problem with the stability with time of the coupler dispersion occurred.

EXAMPLE 7

5.0 g of powdery activated carbon was suspended in 5 liters of cold water at about 5° C., and the suspension was maintained by stirring. A tube filled with the same coupler dispersion as described in Table 1 was immersed in the above prepared suspension of activated carbon for 3 hours, and the tube was then removed. The concentrations of the ethyl acetate and n-butanol were measured, and it was found that the concentrations of the ethyl acetate and n-butanol decreased, respectively, to 0.15 wt% and 0.40 wt%.

Comparative Example 2

A tube filled with same coupler dispersion as described in Table 2 was immersed in 5 liters of dibutyl phthalate (surface tension: 33.1 dyne/cm) maintained at 5° C. for 3 hours, and the tube was then removed. The concentration of the ethyl acetate and n-butanol were measured, and it was found that the both of the concentrations decreased to below 0.1%. However, it was found that the coupler dispersion was contaminated with dibutyl phthalate and that it could not be used as a coupler dispersion.

EXAMPLE 8

10 g of ethyl acetate was introduced into a weighing bottle having inner diameter of 27.8 mm and height of 40 mm. The top of the weighing bottle was then covered with Membrane A used in the present invention or Membrane B as disclosed in U.S. Pat. No. 3,769,206 Brown et al.

| | | |
|---|---|---|
| Membrane A: (present invention) | | |
| | Macroporous Membrane of Polypropylene (made by Polyplastic Co., Ltd., grade 2400) | |
| | Thickness | 25 microns |
| | Porosity | 38 % |
| | Pore Size | 0.020–0.2 microns |
| Membrane B | | |
| | Microporous membrane of Elongated Polypropylene | |
| | Thickness | 22 microns |

The weighing bottle was then stored in a box (50×50×50 cm) for 8 hours under atmospheric pressure at a temperature of 22° C.

Figure 9:
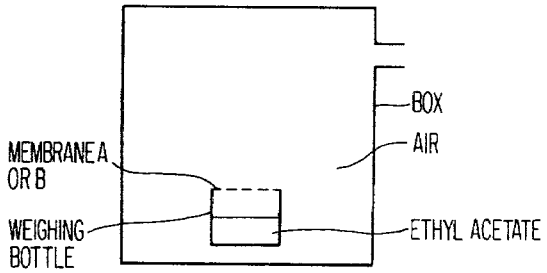
FIG. 9 is a cross-sectional schematic view of the apparatus used in Example 8.

FIG. 9 shows in detail the apparatus used in this Example.

The permeation rate (evaporation rate) of ethyl acetate through Membrane A and Membrane B was thus measured and the results obtained are shown in the Table below.

TABLE

| Membrane | Permeation Rate per Unit Area of Membrane ($g/m^2$ . hour) |
|---|---|
| A | 550 |
| B | 0.63 |

It is apparent from the results shown in the above Table that the permeation rate of ethyl acetate through Membrane A (i.e., a macroporous polypropylene membrane of the present invention) was about 870 times higher than permeation rate of ethyl acetate through Membrane B (i.e., a polypropylene microporous membrane) as disclosed in Brown et al.

While the invention has been described in detail and with reference to specific embodiments thereof, it will be apparent to one skilled in the art that various changes and modifications can be made therein without departing from the spirit and scope thereof.

What is claimed is:

1. A process for removing an auxiliary solvent from a hydrophilic colloid coupler dispersion containing an auxiliary solvent having a boiling point in the range of 60°–100° C. which comprises contacting the hydrophilic colloid coupler dispersion containing the auxiliary solvent with an auxiliary solvent-carrying fluid medium through a hydrophobic macroporous film made of polytetrafluroethylene or polypropylene permeable to the auxiliary solvent and impermeable to the hydrophilic colloid, whereby the auxiliary solvent diffuses from the hydrophilic colloid coupler dispersion through the hydrophobic macroporous film into the auxiliary solvent-carrying fluid medium.

2. The process according to claim 1, wherein the coupler dispersion containing the auxiliary solvent is in a sol state when the coupler dispersion contacts the auxiliary solvent-carrying fluid medium.

3. The process according to claim 1, wherein the coupler dispersion containing the auxiliary solvent is a gel state when the coupler dispersion contacts the auxiliary solvent-carrying fluid medium.

4. The process according to claim 1, wherein said auxiliary solvent-carrying fluid medium is a liquid or a gas.

5. The process according to claim 1, wherein said process includes flowing the auxiliary solvent-carrying fluid medium into contact with said hydrophobic macroporous film.

6. The process according to claim 1, wherein said auxiliary solvent-carrying fluid medium is water, an aqueous solution, air or another inert gas saturated with water vapor.

7. The process according to claim 1, wherein said process comprises passing said coupler dispersion through a tube of said hydrophobic macroporous film and passing said auxiliary solvent-carrying fluid medium into contact with said hydrophobic macroporous film countercurrently to said coupler dispersion.

8. The process according to claim 7, wherein said auxiliary solvent-carrying fluid medium is vapor, air or another inert gas saturated with water vapor.

9. The process according to claim 1, wherein said process comprises passing said coupler dispersion into a space surrounded by said hydrophobic macroporous film, gelling said coupler dispersion therein and passing said auxiliary solvent-carrying fluid medium into contact with said hydrophobic macroporous film on the opposite surface of said hydrophobic macroporous film to the surface contacting said gelled coupler dispersion.

10. The process of claim 1, wherein said hydrophobic macroporous film is made of polytetrafluoroethylene.

11. The process of claim 1, wherein said hydrophobic macroporous film is made of polypropylene.

12. The process according to claim 1, wherein said hydrophobic macroporous film has an average pore size of 0.1 to 40 microns.

13. The process of claim 12, wherein said hydrophobic macroporous film has a pore size of 0.1 to 5 microns.

14. The process of claim 13, wherein said hydrophobic macroporous film has a pore size of 0.2 to 2 microns.

15. The process of claim 1, wherein the pressure difference across said hydrophobic macroporous film is below the water entry pressure.

16. The process of claim 1, wherein the pressure difference across said hydrophobic macroporous film is 0.5 to 1.0 kg/cm$^2$.

17. The process of claim 11, wherein the pressure difference across said hydrophobic film is below the water entry pressure.

18. The process of claim 11, wherein the pressure difference across said hydrophobic macroporous film is about 0.5 to about 1.0 kg/cm$^2$.

19. The process of claim 12, wherein the film thickness is 20 to 1,000 microns.

20. The process of claim 18, wherein the film thickness is 20 to 1,000 microns.

21. The process of claim 12, wherein said process comprises passing said coupler dispersion through a tube of said hydrophobic macroporous film and passing said auxiliary solvent-carrying fluid medium into contact with said hydrophobic macroporous film countercurrently to said coupler dispersion.

22. The process of claim 18, wherein said process comprises passing said coupler dispersion through a tube of said hydrophobic macroporous film and passing said auxiliary solvent-carrying fluid medium into contact with said hydrophobic macroporous film countercurrently to said coupler dispersion.

* * * * *